United States Patent [19]

Wade, Jr. et al.

[11] 4,413,557

[45] Nov. 8, 1983

[54] RIBBON TYPE DATING EQUIPMENT

[76] Inventors: Charles E. Wade, Jr., 81 Myrtle Dr., Manahawkin, N.J. 08050; Fred J. Rapp, 877 Main St., West Creek, N.J. 08092

[21] Appl. No.: 135,210

[22] Filed: Mar. 28, 1980

[51] Int. Cl.[3] ..... B41F 17/24

[52] U.S. Cl. ..... 101/44; 101/336; 400/242; 400/222; 400/218

[58] Field of Search ..... 101/41–44, 101/336; 400/242, 218, 221.2, 222

[56] References Cited

U.S. PATENT DOCUMENTS

| | | | |
|---|---|---|---|
| 2,601,826 | 7/1952 | Huntar et al. | 101/35 |
| 3,176,609 | 4/1965 | Steckling, Sr. | 101/35 |
| 3,752,067 | 8/1973 | Gill | 101/37 |
| 3,878,776 | 4/1975 | Schneider | 101/41 |

*Primary Examiner*—Clifford D. Crowder
*Attorney, Agent, or Firm*—Frederick J. Olsson

[57] ABSTRACT

A ribbon dater which has, improved structure: (a) to quickly reverse the direction of movement of the ribbon so that the same can be re-run thru the printer; (b) to quickly reverse the direction of movement of the ribbon and at the same time provide for a different half of the ribbon to effect the printing; (c) to initiate the printing operation; and (d) to increase printing efficiency but that the type, the ribbon and the part to be printed are all held fixed and printing effected by a movable striker.

10 Claims, 10 Drawing Figures

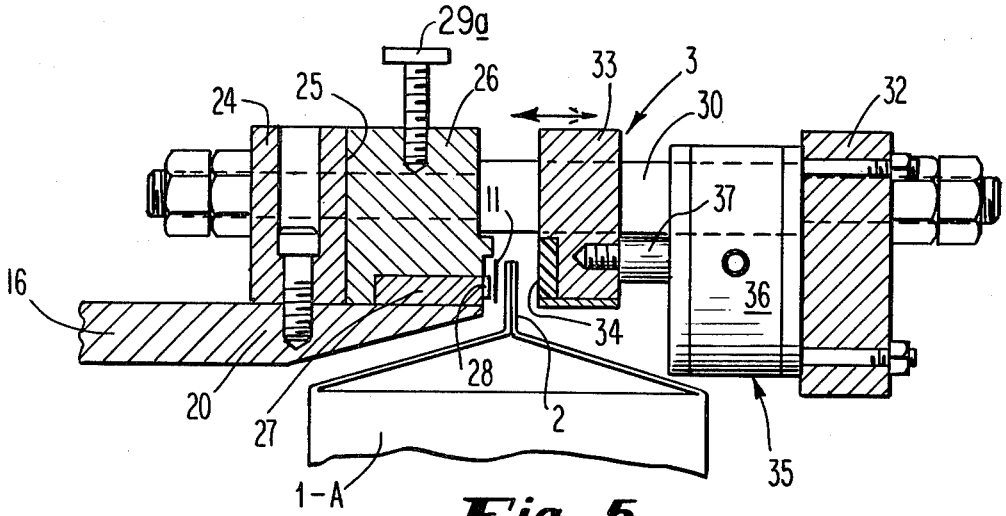
Fig. 5
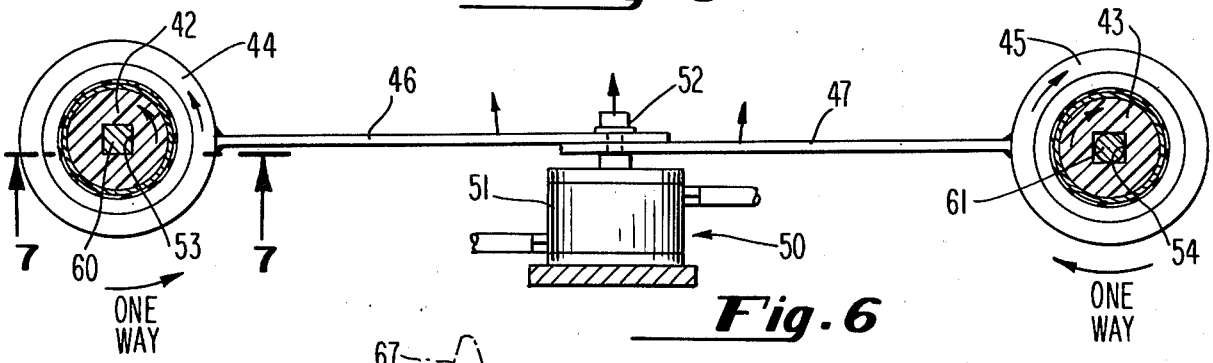
Fig. 6
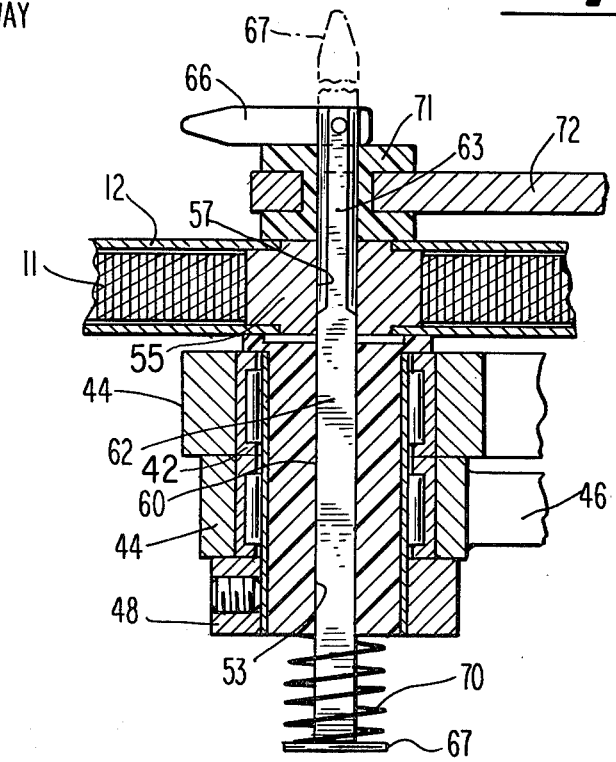
Fig. 7
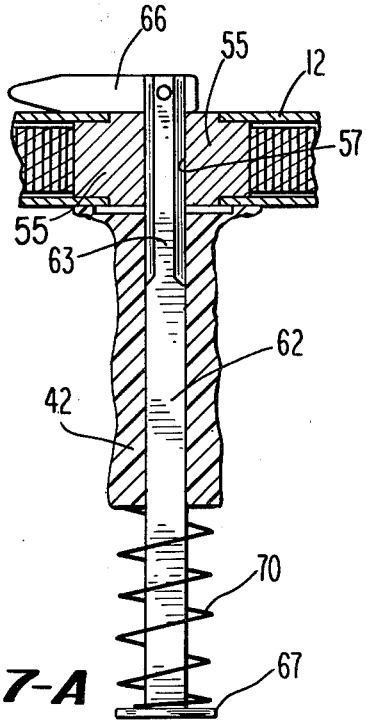
Fig. 7-A

RIBBON TYPE DATING EQUIPMENT

The invention relates to food package equipment to provide intelligence, such as a maximum sale date, on packages as the same are moved along by a conveyor.

Conventionally the maximum sale date (or other intelligence) is placed on packages by the techniques of branding, embossing, leaf printing or ribbon printing as the packages are moved one-by-one into and out of a dating station. The present invention provides for substantial improvements in ribbon printing equipment. One object of the invention is to make available substantial improvements in ribbon printing equipment particularly in means providing that after a face of the ribbon has transversed thru the printer, the ribbon support reels can be quickly reversed in a direction so that the ribbon face can be re-run thru the printer.

Another object of the invention is to provide that when the direction of movement of the ribbon is reversed a different half of the ribbon can be presented to effect printing.

Another object of the invention is to make available substantial improvements in ribbon printing equipment by that for the printing operation the type, the ribbon and the part to be printed are all held fixed and a striker then actuated to push the part and the ribbon against the type whereby the ribbon prints on the part.

Another object of the invention is to make available substantial improvements in ribbon printing equipment particularly in means for initiating the printing operation.

The invention will be explained below in connection with the following drawings wherein.

FIG. 5 is a fragmentary view taken along the lines 5—5 of FIG. 1;

FIG. 6 is a fragmentary view taken along the lines 6—6 of FIG. 2;

FIG. 7 is a fragmentary view taken along the lines 7—7 of FIG. 1;

Figure 8:
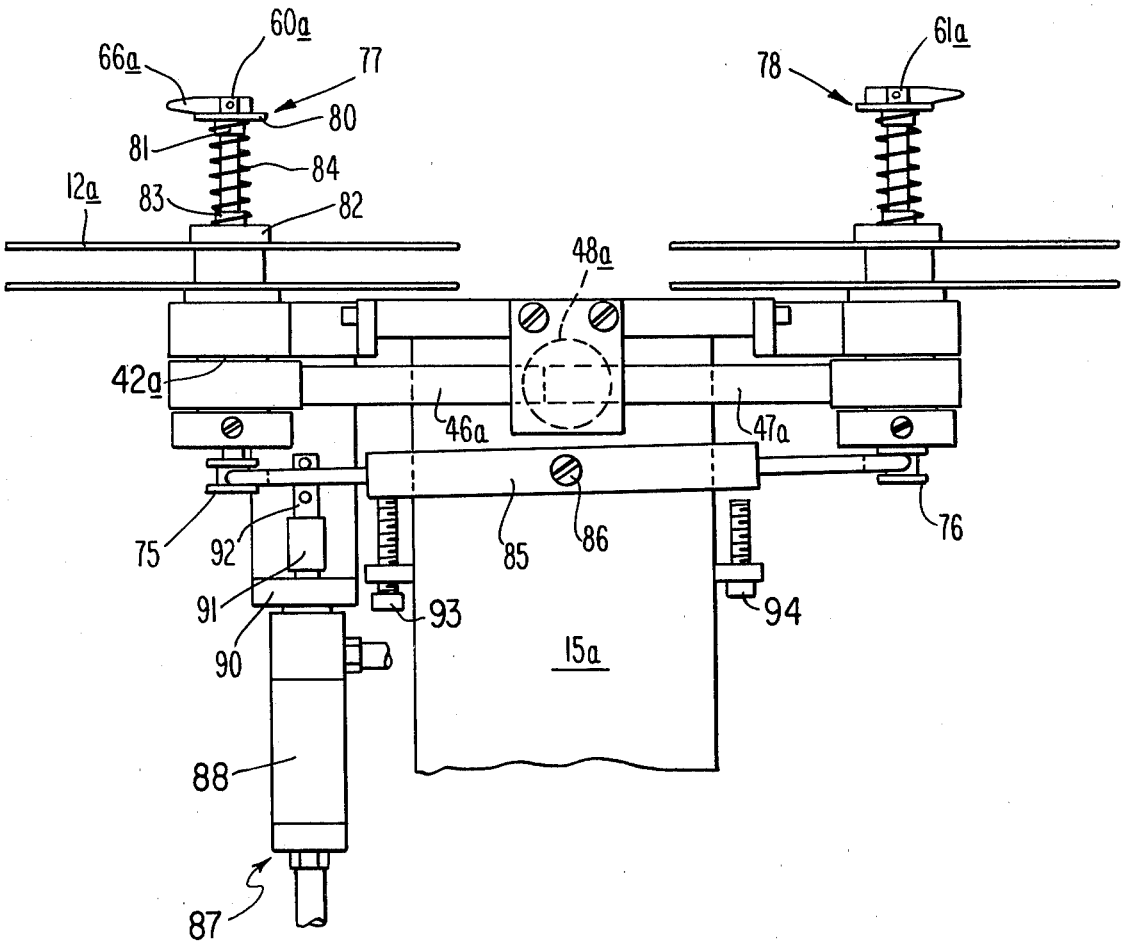
Figure 9:
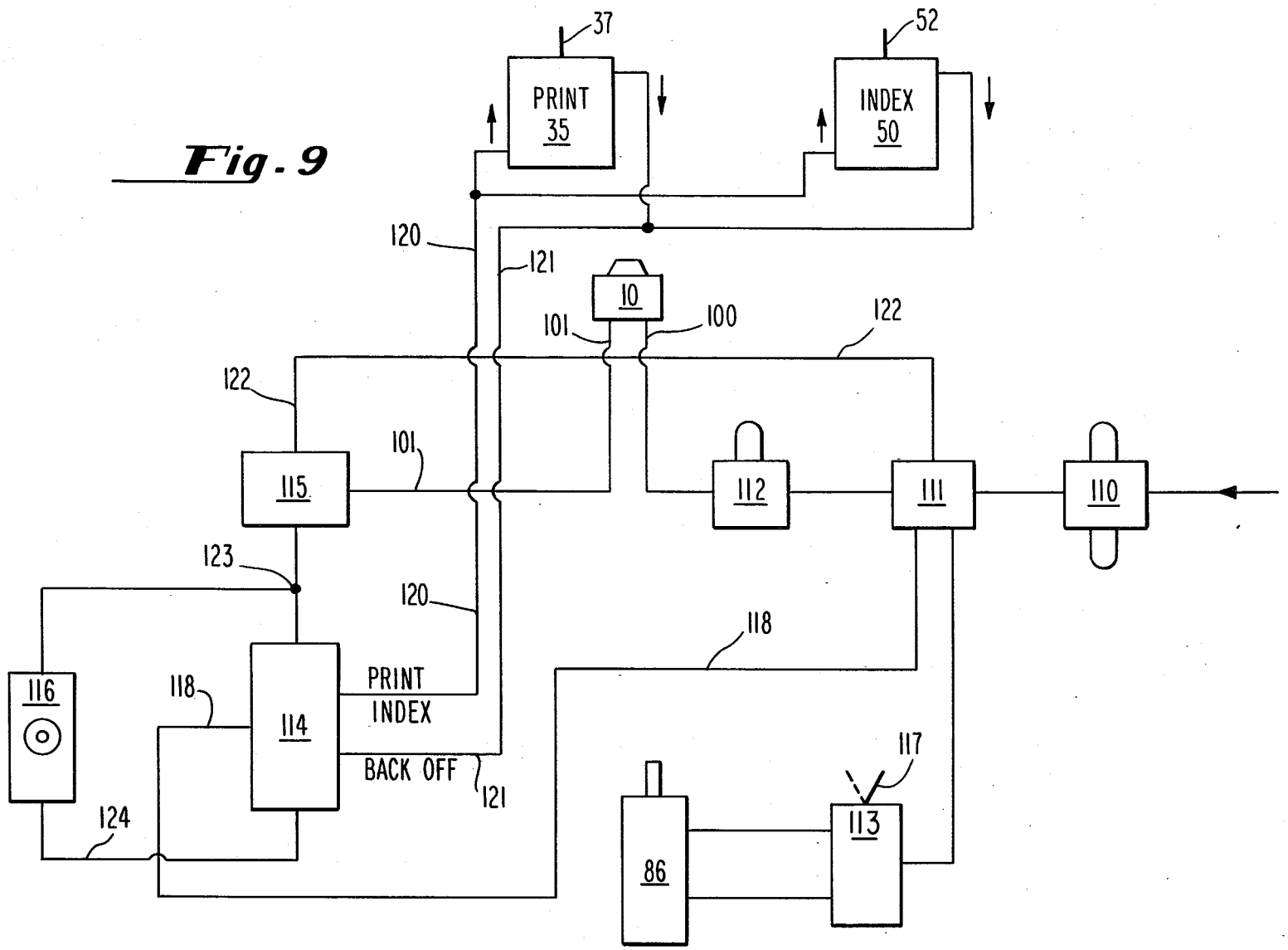

FIG. 7—A is a fragmentary view illustrating certain parts of FIG. 7 in a different position;

FIG. 8 is an elevational view of a ribbon dater having a modified version of the invention; and FIG. 9 is a schematic view of a typical air system used on daters employing the invention;

The invention will be described in connection with ribbon printing of treated-paper cartons such as cartons for milk, cream, juices and the like. Typical cartons are indicated by the numeral 1 in FIGS. 1 and 2. Cartons of the kind in question have flat upstanding panels which are folded against one another at the top and sealed to form an upstanding flange 2.

While the invention is presented in connection with cartons as noted above, it will be understood as the description proceeds that the invention, particularly the printing arrangement, is applicable to other packaging items having an upright flange-like portion for example a flap of an ice cream carton or the end wall of an egg carton.

Figure 1:
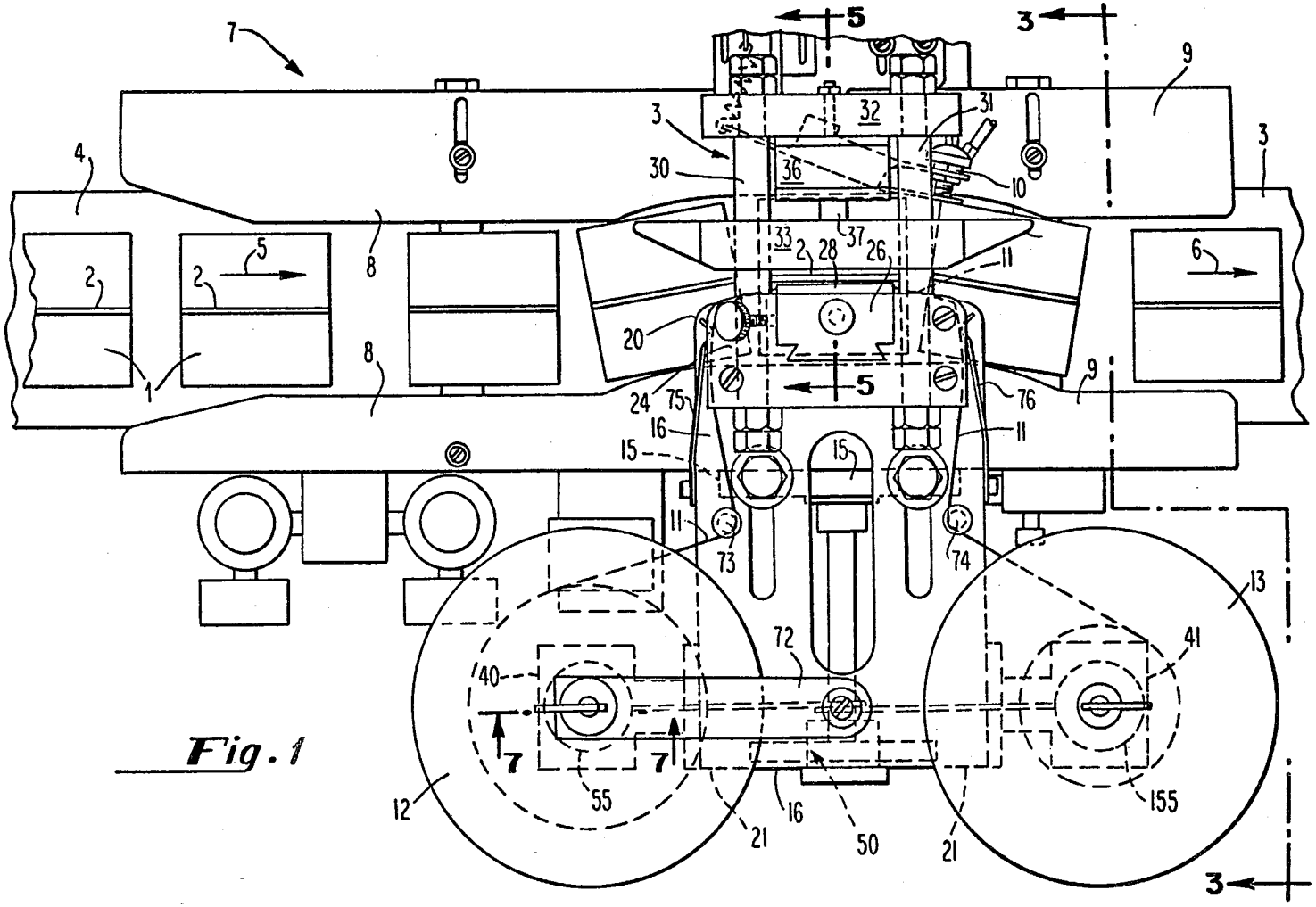
FIG. 1 is a plan view of a ribbon dater incorporating the invention.
Figure 2:
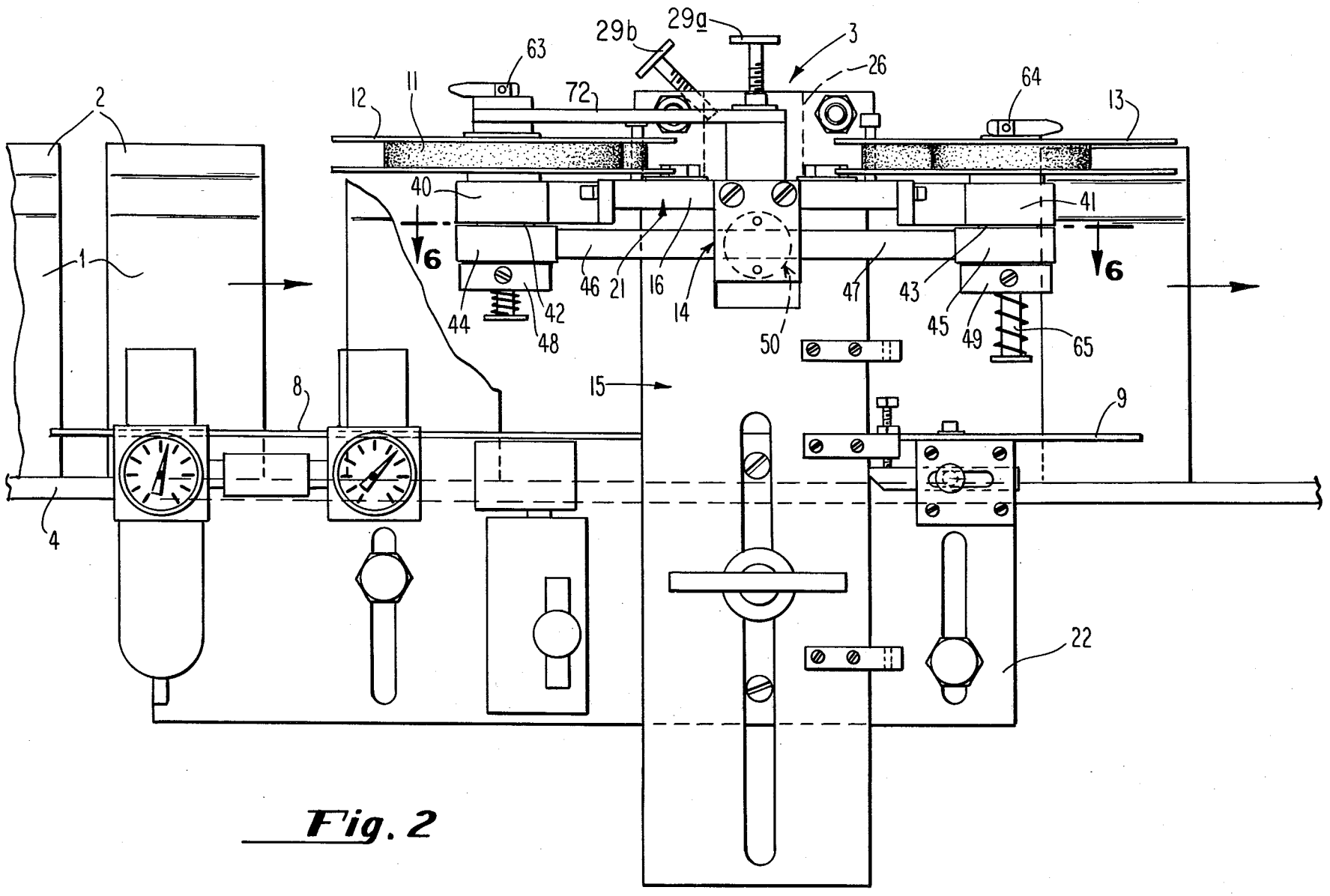
FIG. 2 is an elevational view of the ribbon dater of FIG. 1.
Figure 3:
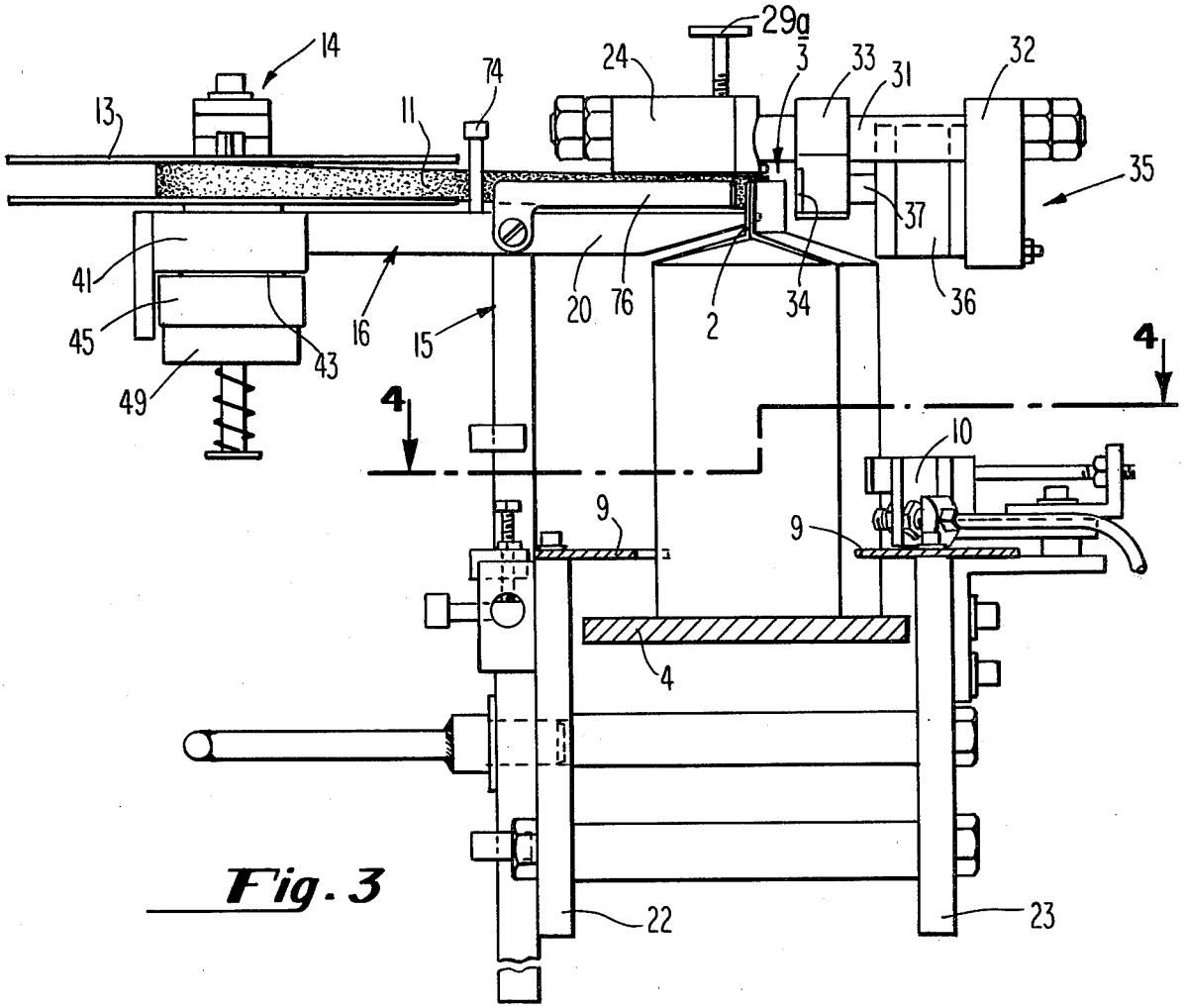
FIG. 3 is an elevational view taken along the lines 3—3 of FIG. 1.

Referring to FIGS. 1, 2 and 3, I will first comment generally on the various components of the equipment.

The date applying means or ribbon printer is generally indicated at 3. This mechanism applies a date to the flange 2 of each carton.

Filled cartons 1 are loaded upright on a conventional conveyor 4 which moves the same to the right (arrows 5) so that the cartons arrive one after the other at the printer 3 for the dating operation and then are moved away from the pinter (arrows 6) after dating.

Guide means 7 includes a section comprising entrance rails 8 which direct the cartons into the printer 3 and a section comprising exit rails 9 which direct the printed cartons out of the printer. The exit rails 8 cooperate with a sensor 10 to control the printing operation. The rails 8 and 9 are joined together below the printer 3 for orienting the cartons for the printing operation as will be noted later.

The printing ribbon 11 is mounted on the reels 12 and 13 and is threaded thru the printer 3. The ribbon is stepped thru the printer (in either direction) by the drive mechanism 14 for the reels.

The above equipment is mounted on framing comprised of various mounting components tied together with conventional fasteners. Various slots are provided for adjusting the relative positions of frame components or parts mounted thereon. The adjustability is to take care of cartons varying in height and/or lateral dimension. The framing includes a vertically extending standard 15 topped by horizontally extending platform 16. The end 20 of the platform on one side of the standard 15 carries the printer 3 while the end 21 on the opposite side of the standard 15 mounts the reels 12 and 13 and the reel drive 14.

The framing also includes the spaced supports 22 and 23 which are connected to the standard 15. The supports 22 and 23 mount the rails 8 and 9. The conveyor 4 runs between the supports 22 and 23 just below the rails 8 and 9. Various components for the air drive system are mounted on the support 22.

The above equipment is adapted to be mounted adjacent the carton line not shown by appropriate connections to the support 22.

Further structural details of the above components will be next be described starting with printer 3.

With particular reference to FIGS. 1, 3 and 5, a block 24 is secured to the end 20 of the platform 16 and has a vertically extending slot 25 which slidably mounts the type carrier 26. A replaceable type block 27 mounting type 28 (FIG. 5) is removably supported by the lower end of the carrier. A knob **29*a* is used for inserting and withdrawing the carrier and a knob 29*b*** is for locking the carrier in position.

The type 28 may extend across the face of the block 27 (FIG. 1) and normally comprises a date or other intelligence to be printed on the flange 2.

The block 24 mounts a pair of horizontally extending rods 30 and 31 the outer ends of which mount a bracket 32. The rods 30 and 31 slidably support a striker 33. The lower end of the striker has a yieldable, replaceable strike pad 34.

The striker 33 is reciprocated back and forth toward and away from the type by the air unit 35. The unit 35 includes the air cylinder 36 fixed to the bracket 32 and a double acting piston, the rod which is indicated at 37. The manner of operating the unit 35 will be described later.

As will be observed, the ribbon 11 extends across the face of the type 28 and the carton flange 2 is disposed between the ribbon and striker pad 34. When the striker 33 is moved to the left as viewed in FIGS. 3 and 5, the pad 34 pushes the flange 2 and ribbon 11 up against the type 28 so that the ribbon prints on the flange. After printing, the striker is moved away and the ribbon indexed (about 1/32"). The printed carton is moved away and the next carton to be printed is moved into position. The manner in which the foregoing is accomplished will also be explained later.

It will be understood that the type will normally effect a degree of embossing on the flange as the printing takes place. This has the advantage of providing cavity to protect the printed matter from being inadvertently wiped away.

It will be evident that for the printing operation the type, ribbon and part to be printed are held fixed in position and acted upon by a movable striker. This arrangement is advantageous from the standpoint of simplifying equipment and providing a desired depth to the impression. The latter is readily controllable by the selection of the weight of the striker.

The arrangement for mounting and driving the ribbon 11 will next be explained:

On opposite sides of the end 21 of the platform 16 are mounted support blocks 40 and 41. Each support block carries a driver in the form of over-ride bearings 42 and 43 (FIGS. 6 and 7). The drivers are conventional items and operate the same as a ratchet. The drivers are stepped or incrementally rotated by the heads 44 and 45 having radial arms 46 and 47. The heads are held on the drivers by the collars 48 and 49. An air unit 50 moves the heads 44 and 45 as noted below.

The air unit 50 comprises the cylinder 51 secured to the platform 16 and having a double acting piston, the rod 51 of which is secured to the arms 46 and 47. As noted in FIG. 7, when the rod 51 is moved out the arm 46 rotates the driver 42 counterclockwise and the arm 47 rotates the driver 43 clockwise. When the piston 50 is moved back carrying the arms 46 and 47 with it, the ratchet operation of the drivers permit the same to remain fixed awaiting the next outward movement of piston rod 51.

The drivers 42 and 43 each have an axially extending square hole as noted at 53 and 54 in FIGS. 6 and 7. The reels 12 and 13 have center spools 55 and 56. Each spool has a square hole such as the square hole 57 for spool 55. The square holes in the spools 55 and 56 are the same size as the square holes in the drivers 42 and 43 and are axially aligned therewith.

Disposed in the square hole of the drivers and spools are the elongated drive shafts 60 and 61. Referring to FIG. 7, the draft shaft 60 has a square portion 62 and a stem portion 63 of smaller cross section than the square portion 62. The shaft 61 has an identical construction with the stem being indicated at 64 and the square portion at 65 in FIG. 2.

Positioning means are provided to axially position each of the drive shafts 60 and 61 to a reel-drive position or to reel-idle position.

The reel-drive position for the shaft 60 is shown in FIG. 7 where it will be seen that the square portion 62 is disposed both in the square hole 53 of the driver 42 and in the square hole 57 of the spool 55 of reel 12. It will be apparent that the shaft 60 will cause rotary motion of the driver to be transmitted to the reel 12.

The reel-idle position of shaft 60 is illustrated in FIG. 7-A. The square portion 62 is down from and disengaged with the square hole 57 of the spool 55. Thus, rotary motion of the driver 42 is not imparted to the reel 12. In the reel-idle position of shaft 60, the stem 63 functions as an axel for spool 55. The shaft 61 has indentical reel-drive and reel-idle position.

One manner of placing the shafts 60 and 61 in the reel-drive and reel-idle positions and how there positions affect ribbon motion will next be explained:

Referring to FIG. 7, the outer end of the stem 63 pivotally mounts a keeper 63. The bottom of square portion 62 carries a foot 67. Between the foot 67 and the bottom of the driver 42 is a spring 70.

The spring 70 urges the shaft 60 downwardly so that the keeper 66 bears on a spacer 71 which in turn bears on the reel 12, urging the same against the driver 42. The reel is held firm but without interfering with rotary motion of the reel with the driver 42.

The spacer 71 functions to position the shaft 60 in the reel-drive position. When the spacer is removed, the shaft can be shifted to the reel-idle position as shown in FIG. 7-A. The spacer is removed as follows.

In FIG. 7 keeper 66 is shown in a radially extending position wherein it abuts the spacer 71. The pivotal connection to the stem provides for the keeper to be shifted to an axially extending position as shown by the dotted lines 67.

The width of the keeper is less than the width of the square holes 53 and 57. Thus, the shaft 60 can be moved down thru the square holes until the keeper is free from the spacer. The spacer then can be moved away and the shaft moved upwardly, the keeper swung into the radial position and then placed against the reel 12 as shown in FIG. 7-A.

The spacer 71 may be a separate item not connected with the equipment, but to avoid possible loss I have mounted the keeper on a selector arm 72. The arm 72 has a pivotal connection with the platform 16 which provides for the arm to swing the spacer from the position shown over reel 12 to a similar position over the reel 13.

The ribbon 11 extends out from the reels 12 and 13 and over the guides 73 and 74 between the block 24 and spring pressure bars 75 and 76 and over the face of the type 28.

With the shaft 60 in the reel-drive position and the shaft 61 in the reel-idle position, the ribbon is moved or stepped thru the printer 3 across the face of the type 28 by being wound onto the reel 12 while it unwinds from the reel 13.

The shaft 61 is placed in the reel-drive or the reel-idle position in the same manner as described for the shaft 60.

When the shaft 61 is placed in the reel-drive position and shaft 60 in reel-idle position, the ribbon will wind onto the reel 13 while it unwinds from the reel 12. Thus, the ribbon will move or step thru the printer in the reverse direction. The same face of the ribbon traverses the type.

The above arrangement is advantageous because it provides for positive and quick change of ribbon direction and thus makes downtime negligible when change is made during a production run (as is usually the case).

The arrangment is particularly suitable for use with minimum height type. In certain kinds of dating work, the height of the characters is one-half or less than the width of the conventional ribbon. While such ribbons can be run and then re-run thru the printer, it is desirable that both halfs of the ribbon be utilized for printing.

In such instance the type block 27 and the type carried thereon are set up so that the type engages the lower half of the ribbon. So after the ribbon is run and re-run, the other half of the ribbon can be put into position for running thru the printer by reversing the positions of the reels 12 and 13. Reel 12 is placed on driver 43 and reel 13 is placed on driver 42. When the ribbon is threaded thru the printer the un-used portion of the ribbon will be positioned to be engaged by the type. To start the ribbon thru the printer the drive/idle condition of the shafts 60 and 61 is changed. After the un-used part has traversed thru the printer, it can be reversed in direction and run thru again.

In FIG. 8, I have illustrated a modified arrangement for changing the drive/idle condition of the reel. The advantage of this arrangement is that operator can simply throw a selector switch to effect the change. Physical manipulation of the shafts is not required.

In the arrangement of FIG. 8, parts which are indentical to corresponding parts described in FIGS. 1-7 are provided with the same letters but followed by lower case letter "a".

The drive shafts have been modified by that the lower ends are provided with followers 75 and 76. On the upper end of the shafts are spring/washer assemblies 77 and 78 which are indentical in construction.

The assembly 77 has an upper washer 80 including the riser 81 and a lower washer 82 with riser 83. The risers hold the spring 84. The spring pushes the washers against the keeper **66*a* and the reel 12*a* to maintain the reel firm against the driver 42*a*. The risers hold the spring so that an assembly can be removed with the spring retaining the washers in position. The assembly 78** has the same construction.

The standard **15*a* supports a tilt arm 85 as by pivot means 86. The outer, opposite ends of the tilt arm 85 engage the followers 75 and 76**.

The tilt arm 85 is adapted to be tilted back and forth by the air unit 87. The cylinder 88 of the air unit mounted on a bracket 90 connected to the standard **15*a*. The cylinder 88 has double acting piston, the rod 91 of which has a yoke 92. The yoke is reciprocated by the air unit 87 and the yoke in turn moves the tilt arm about the pivot means 86**.

In the position shown, the yoke has moved the tilt arm counter clockwise to pull the shaft **60*a* down into the reel-idle position while simultaneously moving the shaft 61*a* up into the reel-drive position. The drive/idle conditions are changed by throwing a switch to change the air pressure in the unit 87** as will be noted later.

Adjusting screws 93 and 94 may be employed to establish the maximum tilting motions of arm 85.

Figure 4:
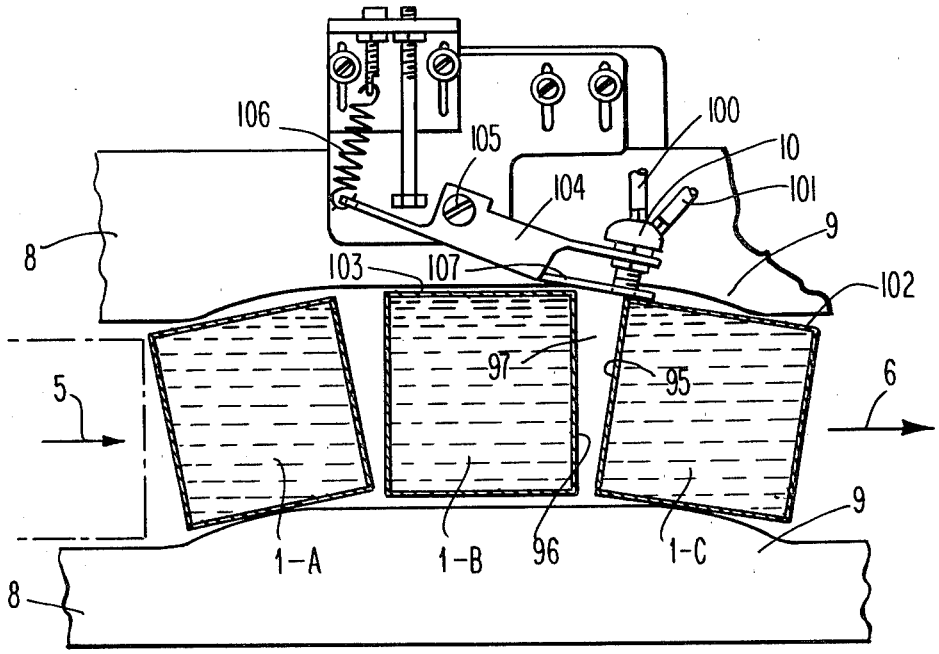
FIG. 4 is a fragmentary view taken along the lines 4—4 of FIG. 3.

The function of the entrance rails 8 and exit rails 9 will be next be described:

Referring to FIGS. 1 and 4, the entrance rails 8 are configured to guide the cartons 2 up to the printer 3 with the flange 2 disposed as previously mentioned.

The cartons are shown mounted on the conveyor 4 in spaced apart condition. This is the ideal condition which, for various reasons, is not maintained in production runs. Many times during a day's run the cartons are jammed together. The fact that the ideal condition is not constant raises problems in properly controlling the printing operation; i.e. insuring that each carton is dated. As noted later, the rails 9 and the sensor 10 cooperate to obtain positive printing control so as to insure that each carton in the run is properly dated.

In the drawings the lateral separations between the entrance rails 8 and between the exit rails 9 are shown somewhat greater than the width of the cartons. This is done for illustration purposes. It will be understood that the rail separation is adjusted so that there is about $\frac{1}{8}''$ or less clearance.

It will be noted that the entrance rails 8 in the area where a carton enters the printer are curved. This causes the carton 1-A (FIG. 4) just entering the printer 3 to rotate about its vertical axis and this separates it from the carton in the printer (in this case 1-B).

The rail structure to cause separation is employed where the environment is that the cartons being moved by the conveyor are likely to be somewhat stuck together. The entrance rails 8 need not be curved to cause separation particularly where it is unlikely the cartons will have a tendency to stick.

The sections of the rails 8 and 9 just below the printer 3 are parallel and will tend to keep the carton 1-B positioned so the flange 2 is properly oriented for printing.

The exit rails 9 in the area where a printed carton 1-C is leaving the printer are curved. This causes the carton 1-C to rotate about its vertical axis so that it separates from the carton 1-B in the printer. The trailing panel 95 of the carton 1-C and the leading panel 96 of carton 1-B are at an angle to one another. This opens a considerable space 97 between the cartons.

The deliberate creation of the space 97 by rails 9 becomes the means to cause the sensor 10 to initiate the re-setting of the system for repeating the printing cycle. Before describing the latter we comment on the nature of the sensor 10 and other components in the air control system of FIG. 9.

The sensor 10 is a conventional air device which has two small orifices surrounded by manifold having a single exit orifice. Line 100 feeds air thru one orifice into the manifold and out the exit orifice. The line 101 is also connected to the manifold.

Pressure in the line 101 is negligible so long as air is moving out of the manifold thru the exit orifice. However, if the exit manifold is blocked, the pressure in line 101 rises and when the exit orifice is unblocked the pressure in line 101 falls. This rise and fall of pressure is used to trigger the printing operation and the indexing operation.

The blocking of the sensor 10 is effected by the adjacent outboard panel of a carton passing by the sensor. The sensor 10 is unblocked when the cartons separate to create space 97.

Referring to FIG. 4, the outboard panel 102 of the carton 1-C is just being disengaged with the sensor 10. As the carton 1-C continues to move the panel 102 completely disengages and the space 97 is presented to the exit orifice of sensor 10 and the air is free to flow out. As the carton 1-B moves along its outboard panel 103 engages the exit orifice to block the same and increase pressure in line 101.

The sensor 10 is mounted on arm 104 mounted on the frame by pivot 105. Spring 106 urges the arm clockwise so that the slide 107 engages the outboard panels of the cartons as they pass by. The exit orifice of the sensor is substantially flush with the surface of the slide which engage the outboard panels.

It will be understood that the axial and lateral position of the sensor 10 shown in the drawings is for illustrative purposes. The exact position is adjusted as a function of the dimensions of the cartons, the speed of the conveyor, reaction time of the various components of the air system and the like.

Other components in the air control system of FIG. 9 will now be described:

Air from a source not shown supplies air to a filter/-regulator 110 which in turn supplies air at the desired pressure to the distributor 111 which transfers air to a low pressure regulator 112, a control valve 113, a control valve 114 and a control unit 115. A time delay 116 is in parallel with valve 114.

The low pressure regulator 112 passes low pressure air to the sensor 10 via line 100 mentioned above. The line 101 from the sensor is connected to the control unit 115.

The control valve 113 supplies air to one side or the other of the piston in the reel drive/idle air unit 86 (FIG. 8) depending on the setting of the flip switch 117. By merely setting the switch 117, the operator can change the direction of movement of the ribbon 11 as previously described.

The control valve 114 functions to simultaneously pass high pressure air from line 118 to the pistons in printer air unit 35 and in reel-drive air unit 50. When air goes via print/index line 120, the units cause printing and reel indexing. When air goes via back-off line 121 the pistons retract. When one side of a piston has high pressure the opposite side is vented to exhaust via the valve 114.

The control unit 115 and time delay 116 work in conjunction with one another to control operation of the valve 114.

The control unit 115 receives high pressure air from line 122 and as a function of the pressure in line 101 and either transfers the high pressure air to line 123 or blocks such transfer.

The time delay 116 passes the high pressure air in line 123 to line 124. As will presently be explained, the air pressure in lines 123 and 124 determines whether valve 114 passes high pressure air to line 120 or to line 121.

Further details regarding the operation of the control valve 114, control unit 115 and time delay 116 follow.

The transfer of air by valve 114 is effected by a spool whose position is controlled by air pressure on its opposite sides in conjunction with a spring on one side.

When air pressure in lines 123 and 124 are equal, the air pressures on opposite sides of the spool are balanced. The spring is effective to move the spool to a normal position.

In the normal position, the spool connects print/index line 120 to vent and transfer high pressure air from line 118 to the back-off line 121 and the pistons in the air units 35 and 50 are retracted. The printer striker 33 and the drive heads 44 and 45 are in ready condition or re-set positions for the next printing and indexing operation.

When air pressure in line 123 is greater than the air pressure in line 124 the pressure on the spool side opposite the spring is so great that the spool is moved against the spring away from normal to another position. The spool then connects the back-off line to vent and transfers high pressure air from line 118 to print/index line 120. The striker 33 is moved to its print position to effect dating and the heads 44 and 45 are rotated to effect indexing. When the air pressures equalize, the spring shifts the spool to normal position. The spool connects print/index line 120 to vent and transfers pressure air to the back-off line 121.

The control unit 115 and time delay 116 function to cause the changes in pressure in lines 123 and 124 as noted below to operate the spool in valve 114 as just described.

The control unit 115 has a control spool connected to a rubber diaphram subject to the pressure level in line 101. When the pressure in line 101 is low, the diaphragm holds the spool in a normal position. When the pressure in line 101 rises, the diaphram is moved which shifts the spool to another position. When the pressure in line 101 falls, the diaphram shifts the spool back to normal.

In the normal position, the high pressure air from line 122 is blocked and the line 123 is connected to the vent. When the spool is shifted by the pressure rise in line 101, the high pressure air from line 122 is transferred to line 123.

The time delay 116 between line 123 and 124 has an adjustable orifice in parallel with a check valve. The check valve blocks air flow from the line 123 to line 124 but will pass air from 124 to 123. The orifice bleeds high pressure air in line 123 to line 124 until the pressures in the two lines equalize.

As noted above the printing and indexing take place simultaneously. If the printer grips the ribbon prior to completion of indexing, the ribbon will stretch and the index step completed when the ribbon is released.

With the above in mind, the printing and indexing operations will be explained.

With reference to FIG. 4, assume that the side panel 102 of carton 1-C has just disengaged from the sensor 10 and its exit orifice is unblocked. The pressure in line 101 decreases and diaphram in control unit 115 goes to normal. Line 118 is blocked and line 123 is vented. The control unit 115 is now re-set.

When carton 1-B moves to the right the side panel 103 engages and blocks off the exit orifice of the sensor 10. The pressure in line 101 rises. The diaphram in control unit 115 is shifted. High pressure air from line 122 is transferred to line 123. This high pressure air in line 123 goes to the spool in valve 114 and starts to blend thru the orifice in time delay 116 so pressure in line 124 is less than the pressure in line 123. The high pressure moves the spool against the spring from its normal position. The spool then transfers high pressure air from line 118 to the print/index line 120 and connects the back-off line 121 to vent. The carton 1-B is printed. The ribbon is indexed.

Immediately after printing and indexing, the time delay orifice has finished bleeding so as to equalize the pressures in lines 123 and 124. The spring in valve 114 now shifts the spool to normal. The spool transfers high pressure air from line 120 to line 121. The printing and indexing mechanism are now re-set for the next operation.

The above condition is maintained until the panel 103 is disengaged from the exit orifice of the sensor 10. Since the cartons are separated, the air is free to flow from the exit orifice and the pressure in line 101 drops. The control unit diaphram moves the spool to normal. The control unit is now re-set for the next operation.

When the side or outboard panel of the next carton 1-A engages and blocks the exit orifice of sensor 10 the cycle is repeated.

From the foregoing detailed description it becomes apparent that the valve 114 and time delay 116 form a printing and indexing control entity conditioned to cause printing and indexing by the control unit 115, the control entity being internally re-set by time delay 116 and the spring of valve 114. Further it becomes apparent that the control unit 115 and sensor 10 constitute a regulator for the printing and indexing control 114/116 which is conditioned to initiate the printing and indexing function by the outboard side of a carton and which is re-set by the separation between cartons.

Before concluding it is pointed out that the various mechanisms, per se, in the air control system are of conventional structure.

I claim:

1. In a ribbon dater:

frame means;

a pair of spaced apart drivers respectively rotatably mounted on said frame, each driver having an axially extending square hole, the holes being the same size;

means for incrementally rotating said drivers by the same amount simultaneously in opposite directions;

a pair of ribbon reels carrying a printing ribbon, each reel having an axially extending square hole of the same size as said driver holes, the reels being respectively removable disposed on said drivers with said square holes in axial alignment and the reels being adapted to be disposed on either driver;

a pair of elongated drive shafts, each having a square portion and a stem portion, the stem portion being of smaller cross section than the square portion and the square portion being the same size as said driver holes, the shafts being respectively disposed in said aligned holes;

positioning means operable to axially position each drive shaft to a reel-idle position or to a reel-drive position, in the reel-idle position the square portion of the drive shaft being disposed in the square hole of the driver for rotation therewith but spaced from the square hole in the reel whereby rotary motion of the driver and the drive shaft is not transmitted to the reel and in the reel-drive position the square portion of the drive shaft being disposed in the hole of the driver for rotation therewith and also disposed in the square hole of the reel whereby rotary motion of the driver and the drive shaft is transmitted to the reel;

printing means on said frame, said ribbon extending thru said printing means and the ribbon being moved thru the printing means by rotation of a drive shaft when in said reel-drive position; and said positioning means providing for one drive shaft to be in the reel-drive position while the other drive shaft is in the reel-idle position for running said ribbon thru said printing means in one direction and for the reel-idle and reel-drive positions of the respective drive shafts to be changed for re-running the ribbon thru said printing means in the reverse direction to thereby re-use the face of the ribbon effecting said printing.

2. The ribbon dater of claim 1 wherein said positioning means comprises:

spacer means adapted to be disposed on top of one or the other of said reels and having an axially extending hole, the hole being in axial alignment with the hole in the reel on which the spacer is disposed;

for each drive shaft, keeper means pivotally connected adjacent the end of said stem portion of the shaft and movable to an axially extending position wherein the keeper and its drive shaft are movable axially thru said aligned holes in the spacer, reel and driver and also movable to a radially extending position wherein the keeper restrains said axial movement; and said spacer and keepers being operable to establish said reel-drive and reel-idle positions so that when the spacer is on one reel with the keeper of the drive shaft in its radial position, the keeper engages the top of the spacer and positions the drive shaft in the reel-drive position while at the same time with the keeper of the other drive shaft in its radial position, the keeper engages, the top of the other reel and positions the other drive shaft in reel idle position.

3. The ribbon dater of claim 2 further including a selector arm one end of which carries said spacer and the other end of which is pivotally connected to said frame, the pivot connection providing for the arm to be shifted for placing said spacer on one reel or the other.

4. The dater of claim 1 wherein said printing means comprises:

a type carrier including printing type;

means mounting the carrier on the frame to be fixed thereon and to be removed therefrom whereby the same can be replaced by another carrier and type and in the fixed position being oriented for the ribbon to extend across the face of the type for the printing operation;

a striker movable to engage the part to be printed and push the same against the ribbon and type whereby the ribbon prints on the part and the striker being movable away from the ribbon after the printing operation; and means to move said striker.

5. The dater of claim 4 wherein the type is constructed to engage the ribbon on one half or less of the transverse dimension of the ribbon and the other part of the ribbon being employed so that the removability of the ribbon reels provides for the ribbon reels to be interchanged as between drivers and said positioning means provides, when such interchange is made, for the reel-idle and reel-drive condition of the respective drive shafts to be changed for re-running the ribbon thru said printing means in the reverse direction whereby to provide for the type to engage said other part of the ribbon.

6. The ribbon dater of claim 1 wherein said positioning means comprises:

motor means; and drive mechanism connected to said motor means to be actuated thereby and connected to each of said drive shafts to respectively axially shift the same and the drive mechanism, when actuated by said motor means, shifting one drive shaft to the reel-drive position and simultaneously shifting the other shaft to the reel-idle position and vise-versa.

7. In a ribbon dater;

frame means;

a pair of spaced apart drivers respectively rotatably mounted on said frame, each driver having an axially extending square hole, the holes being the same size;

means for incrementally rotating said drivers by the same amount simultaneously in opposite directions;

a pair of ribbon reels carrying a printing ribbon, each reel having an axially extending square hole of the same size as said driver holes, the reels being respectively removably disposed on said drivers with said square holes in axial alignment and the reels being adapted to be disposed on either driver;

a pair of elongated drive shafts, each having a square portion and a stem portion, the stem portion being of smaller cross section than the square portion and the square portion being the same size as said driver holes, the shafts being respectively disposed in said aligned holes;

positioning means operable to axially position each drive shaft to a reel-idle position or to a reel-drive position, in the reel-idle position the square portion of the drive shaft being disposed in the square hole of the driver for rotation therewith but spaced from the square hole in the reel whereby rotary motion of the driver and the drive shaft is not transmitted to the reel and in the reel-drive position the square portion of the drive shaft being disposed in the square hole of the driver for rotation therewith and also disposed in the square hole of the reel whereby rotary motion of the driver and the drive shaft is transmitted to the reel, said positioning means including:

(a) motor means mounted on said frame and having a reciprocating plunger; and (b) a tilt-arm having a pivot connection with said frame, the tilt-arm on one side of said pivot connection being connected to said plunger to be moved thereby and also connected to one of said drive shafts to axially move the same and the tilt-arm on the opposite side of said pivot connection being connected to the other drive shaft to axially move the same and said plunger, when moved in one direction, rotating said tilt arm to position one drive shaft in the reel-drive position and simultaneously position the drive shaft in the reel-idle position and vise-versa, printing means on said frame, said ribbon extending thru said printing means and the ribbon being moved thru the printing means by rotation of a drive shaft when in said reel-drive position; and said positioning means providing for the reel-idle and reel-drive condition of the respective drive shafts to be changed for re-running the ribbon thru said printing means in the reverse direction to thereby re-use the face of the ribbon effecting said printing.

8. The dater of claim 7 further including:

for each drive shaft, keeper means pivotally connected adjacent the end of the stem portion of the shaft, a spring disposed on the stem portion of the shaft, a washer on the shaft engaging the keeper means and the spring extending between the washer and the reel on the shaft to maintain the reel against the driver, and the pivotal connection of the keeper means providing for the keeper means to be movable to an axially extending position wherein the keeper means and its drive shaft are movable axially thru said aligned holes in the spacer, reel and driver and also for the keeper means to be movable to a radially extending position for restraining said axial movement when the keeper means is in said radially extending position.

9. In equipment to manipulate a carton having panels and a flange-like part to be provided with a date, the equipment including conveyor means to move a plurality of said cartons disposed side-by-side one another so that the cartons are moved one after another into a date applying station and thereafter to move the dated cartons away from the date applying position:

first guide means for guiding said moving cartons one after the other along an axis into the date applying station wherein said flange-like part of the carton is disposed for the dating operation;

second guide means to receive a moving carton after the same has been dated and to rotate the carton about its vertical axis whereby the trailing panel of the dated carton and the leading panel of the carton in the date applying station are oriented at an angle to one another and thereby separated.

date applying means movable to a printing position and to a ready position;

regulating means to develop a control signal and thereafter to be re-set for developing another control signal;

control means connected to said date applying means and to said regulating means to receive said signal and then cause said date applying means to move to the printing position and the control means further having means to cause the date applying means to move to the ready position immediately after moving to the printing position; and said regulating means having a sensor disposed adjacent the second guide means in close proximity to the outboard panels of cartons passing therealong to cause the regulating means to develop said control signal as a function of the presence of the outboard panel adjacent the sensor and to cause said regulating means to re-set as a function of said carton separation.

10. The dater of claim 9 wherein said first and second guide means comprises:

spaced apart rail means to respectively engage the two opposite outboard panels of the cartons;

rail means of the first guide means immediately below said date applying means being parallel to one another and rail means of the second guide means immediately adjacent last said parallel rail means respectively being oriented and at an angle thereto whereby to effect said rotation of the just-dated carton.

* * * * *